United States Patent [19]

Koester

[11] Patent Number: 4,813,192

[45] Date of Patent: Mar. 21, 1989

[54] DOOR ASSEMBLY

[75] Inventor: Frank Koester, Forest Hills, N.Y.

[73] Assignee: A Collaberation of 3 Designers, New York, N.Y.

[21] Appl. No.: 54,801

[22] Filed: May 27, 1987

[51] Int. Cl.[4] ..... E06B 1/04

[52] U.S. Cl. ..... 52/207; 52/311; 232/45

[58] Field of Search ..... 52/207, 204, 210, 311, 52/457, 455; 232/22, 45, 46, 19

[56] References Cited

U.S. PATENT DOCUMENTS

| | | | |
|---|---|---|---|
| 2,849,175 | 8/1958 | Thieman | 232/45 X |
| 3,197,931 | 8/1965 | Seery | 52/210 X |
| 3,568,383 | 3/1971 | Judkins et al. | 52/210 |
| 3,811,238 | 5/1974 | Brinker | 52/204 |
| 4,502,249 | 3/1985 | Banford | 52/207 X |

*Primary Examiner*—Carl D. Friedman

*Attorney, Agent, or Firm*—Abraham Ogman

[57] ABSTRACT

The invention is directed to a door assembly comprising a door and removable matching panels spaced to the side of the door forming the front wall of a side panel assembly. The side panel assembly includes an interior passage for placing accessories or appliances on the front wall. A novel mail box slot is also described.

6 Claims, 3 Drawing Sheets

DOOR ASSEMBLY

BACKGROUND OF THE INVENTION

This invention is directed to a door assembly and more particularly to a door assembly which includes means for mounting accessories such as a mail slot graphics panels and the like. The structure of the door assembly lends itself to harmony in design.

Conventional single doors are generally supported, vertically, between two door jambs. While there is room for electrical wiring within the jamb and a mail slot in the door it is not practical to mount electronic surveillance equipment on or in the door. The need to meet fire codes makes it impractical to provide removable graphics panels on the door.

As tenants come and go there is often a need to change numbers on the doors as well as the names of the tenants. Conventional door assemblies often require the replacement of a door to accomplish these changes.

OBJECTS

It is an object of the invention to provide a door assembly which avoids the limitations and disadvantages of prior door assemblies.

It is another object of the invention to provide a door assembly which includes means for enclosing accessories.

It is another object of the invention to provide a door assembly that includes side panels which may contain accessories.

It is yet another object of the invention to provide a door assembly with side panels which side panels may be easily removed.

It is still another object of the invention to provide a door assembly with side panels with space behind the panels for accessories.

Yet another object is to provide a mail slot with removable and interchangeable plates for a door bell and suite number.

It is still another object of the invention to provide a door assembly which can be fitted with a removable center jamb though there is only a single door.

SUMMARY OF THE INVENTIONS

In accordance with the the invention a door assembly is frame by first and second door jambs. Included is a third door jamb spaced at the side of the second door jamb. The second and third door jambs include means for mounting at least one but preferably a plurality of panels to form a front wall of a side panel assembly.

There is also included a mail slot which includes removable and interchangeable plates for accommodating a door bell and a suite number.

The above objects and other objects and advantages of the the present invention will appear more clearly form the following specification in connection with the accompanying drawing, in which FIG. 1 is a elevation views of the door assembly encompassing the invention.

Figure 1:
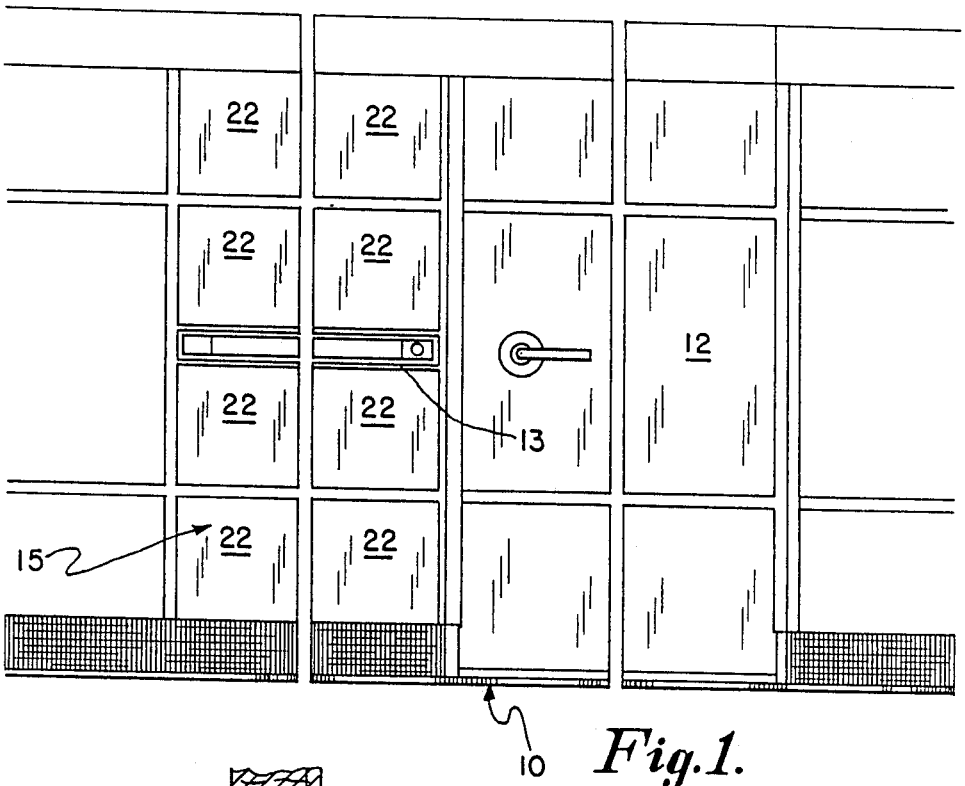

There is depicted in FIG. 1 a front view of a door assembly 10 including a door 12 and to the left of the door 12 a number of replaceable panels 22 forming the front wall of a side panel assembly 15. A mail slot 13 is defined through the front wall and though a rear panel 20.

Figure 2:
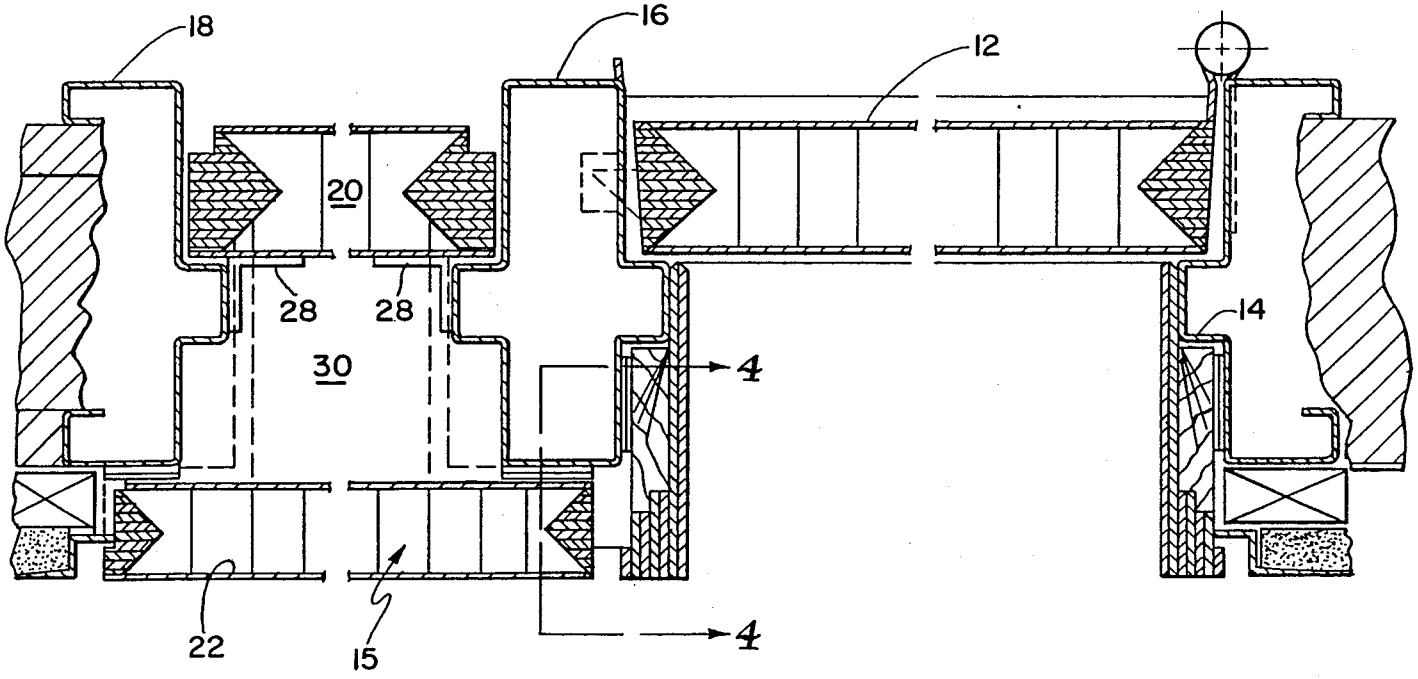
FIG. 2 is a section taken along line 2—2 of FIG. 1.

The door 12 is supported by first and second door jambs 14 and 16 respectively. See FIG. 2. A third door jamb 18 is spaced from door jamb 16 forming a space 30 in between.

Figure 4:
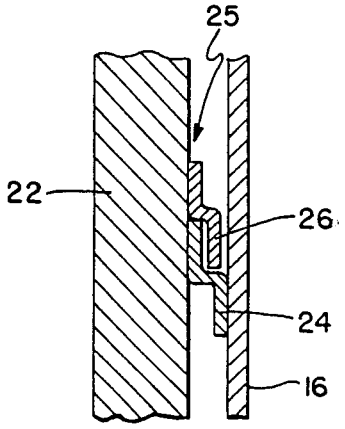
FIG. 4 is detail of the means for mounting panels to the door assembly taken along line 4—4 in FIG. 2.

In most cases the door 12 is fire rated. That is to say it is made to hold back a fire for a period of time such as 1 hour or 1.5 hours. There is also provided a fire rated panel 20 mounted to door jambs 16 and 18 by brackets 28 to carry the fire protection into the side panel assembly 15. The front "wall" of the side panel assembly 15 is made up of a plurality of so called graphic panels 22. These graphic or wall panels are mounted on the door jambs 16 and 18 by means of a bracket assembly 25 made up of "Z" shaped cleats 24 and 26. See in particular FIG. 4. The wall panels 22 may be removed and replaced by simply lifting a wall panel 22 up so that the cleat 26 clears the cleat 24. The wall panels 22 in this instance are held in place by gravity.

Figure 3:
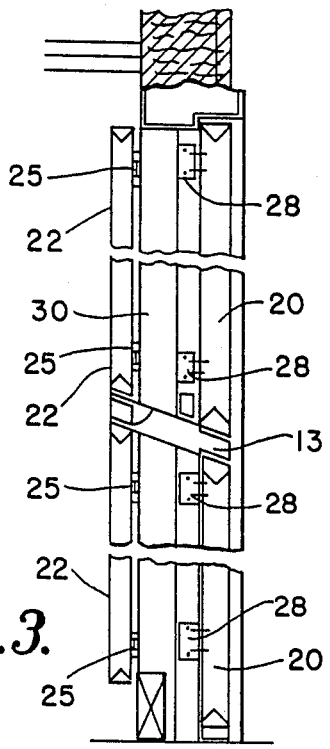
FIG. 3 is a section taken along line 3—3 of FIG. 1.

Alternatively the side panel assembly 15 can be said to comprise a coplanar arrangement of wall panels 22 (See FIG. 3) which are releasably secured to said second and third door jambs 16 and 18 (See FIGS. 2–4) so that they may be removed and replaced without dismantling other parts of the door assembly.

The wall panels 22 and the fire rated panel 20 in the illustrations are configured to contain a mail slot 13 which is secured to the door jams 16 and 18.

The wall or graphic panels 22 can serve several functions. They can carry the name of the tenant occupying the space behind the door. Where a tenants name changes the obsolete panel is removed and another substituted. The veneer of the door as well as the veneer of the graphics panels 22 are man-made and can be accurately matched.

Another feature of the invention is the space 30 in the side panel assembly 15. There is sufficient space to carry electrical wires for door releases, door bells, or electronic keys. There is also sufficient space to mount within the space 30 a surveillance camera such as the 68c video door vision camera.

Where a camera is used one of the opposing graphic panels 22 will contain a complementary door plate permitting one to see through the front wall panel.

Figure 5:
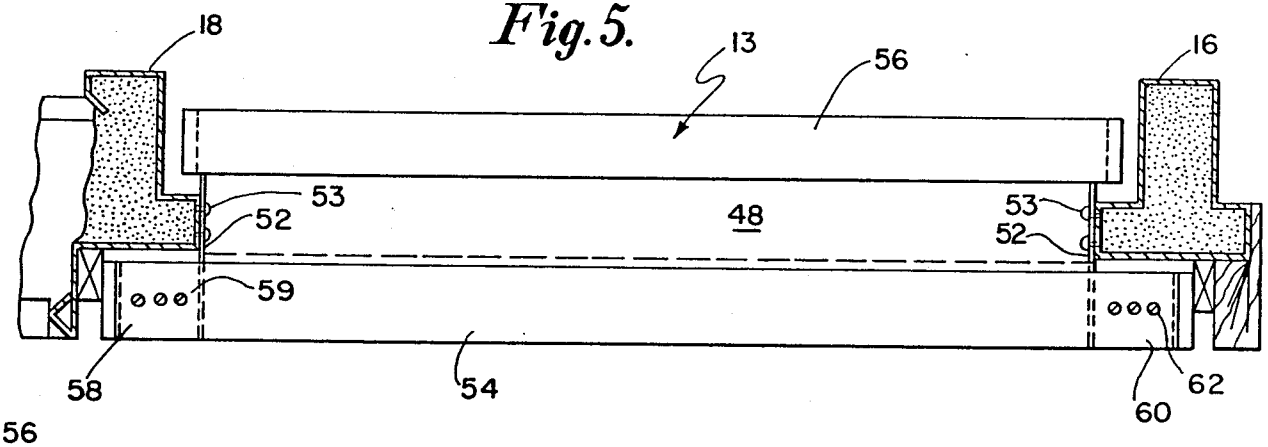
FIG. 5 is a top view of a mail slot embodying the principles of the invention.

Referring to FIG. 5 of the drawings there is top detail view of the mail slot 13. The mail slot 13 contains a center body 48 defined by top, bottom, and side walls situated between an interior frame 56 and and exterior frame 54. The walls of the center body define a front opening 55 and a rear opening (not shown) through which mail etc. passes. The exterior frame 54 and the interior frame 56 encircle and frame the openings.

The exterior frame 54 contains identical left and right lateral extensions 58 and 60. Holes for screws 59 and 62 are formed in the extensions 58 and 60 respectively. Shown in the Figures are two lateral extensions. Clearly a Single lateral extension may be used as well.

The mail slot 13 is secured to the door assembly by screwing a mounting bracket 52 afixed to the body 48 to the second and third door jamb as shown in FIG. 5.

Figure 6:
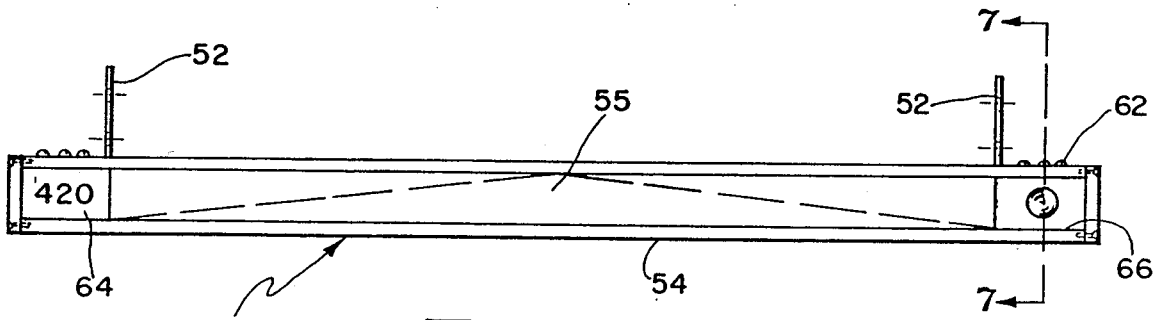
FIG. 6 is a front view of the mail slot.
Figure 7:
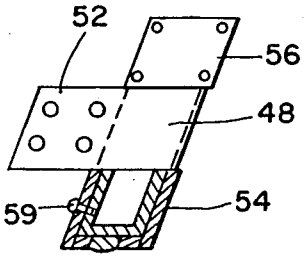
FIG. 7 is a section of the mail slot taken along line 7—7.

An important feature of the mail slot 13 are removable and interchangeable suite numbers 64 and door bell plates 66 shown in FIG. 6. These are inserted in the extensions 58 and 62 and secured to the front frame 54 by means of screws 59 and 62 inserted in the extensions. See FIG. 7.

The suite number plate 64 and the door bell plate 66 are placed into position by removing the graphic plates 22 above the mail slot 13 (See FIG. 1).

The important features of the inventions are a door assembly containing removable graphic panels that make up a front side panel assembly, A space is provided behind the front side panel assembly for accessories. There is also included a mail slot which contains removable and interchangeable suit number and door bell plates. All of these features are coordinated into an attractive door assembly.

The second door jamb can be made removable to facilitate the movement of large objects through the door.

The door assembly is designed to project the stature of a double door thus providing a prominent profile to all building renters.

The technical and cost advantages are in the doors reusable kit of parts. The fire rated door is too expensive to throw-away whenever a tenant vacated the property. On the other hand, the removable panel has less cost involved in its production. The use of man-made wood allows a thicker veneer which makes matching and refinishing easier.

The maintenance factors available with the reusable qualities of the door assembly. There is also the ease of adding accessories or appliances such as video cameras and electronic keys. The layer quality of the jamb and other components have been cited as giving the impression that there is more door than actually exits. This is thought to have been a deterrent in several cases.

While there has been shown and described what is at present considered to be the preferred embodiment of the invention, it will be obvious to those skilled in the art that various changes and modifications may be made therein without departing from the true scope of the invention as defined in the appended claims.

I claim:

1. A door assembly comprising:

a first second and third spaced apart vertical door jambs;

a door hung between the first and second door jamb;

first mounting means on said second and third door jambs; and a front wall assembly comprising at least one front wall panel having second mounting means complementary to said first mounting means for releasably securing said front wall panel to said second and third door jambs whereby said front panel may be removed and replaced without dismantling other parts of the assembly.

2. A door assembly as defined in claim 1 where the door jambs are generally rectangular with the long dimension oriented front to back and said first mounting means are secured to the front of the jambs.

3. A door assembly as defined in claim 1 containing in addition a mail slot configured to fit through a front wall panel, said mail slot having a lateral extension coplanar with said front panel assembly and adapted to contain a removable plate.

4. A door assembly as defined in claim 3 where the mail slot contains left and right lateral assemblies each adapted to contain a removable plate.

5. A door assembly as defined in claim 1 where said front wall assembly comprises a plurality of vertically aligned coplanar panels.

6. A door assembly comprising:

a door hung between first and second door jambs;

a third door jamb spaced adjacent to said second door jamb;

a rear panel hung between the second and the third door jambs in the same plane as the door;

first mounting means on said second and third door jambs; and a front wall assembly spaced apart forward of the rear panel, said front wall assembly comprising at least one wall panel having second mounting means complementary to said first mounting means for releasably securing said wall panel to said second and third door jambs whereby said wall panel may be changed.

* * * * *